US010112088B1

(12) United States Patent
Moran et al.

(10) Patent No.: US 10,112,088 B1
(45) Date of Patent: Oct. 30, 2018

(54) GOLF FLAG MARKER

(71) Applicants: Michael Moran, Milford, MI (US); Melissa Moran, Milford, MI (US)

(72) Inventors: Michael Moran, Milford, MI (US); Melissa Moran, Milford, MI (US)

( * ) Notice: Subject to any disclaimer, the term of this patent is extended or adjusted under 35 U.S.C. 154(b) by 0 days.

(21) Appl. No.: 15/642,891

(22) Filed: Jul. 6, 2017

(51) Int. Cl.

| | |
|---|---|
| ***A63B 57/00*** | (2015.01) |
| ***A63B 57/30*** | (2015.01) |
| *A63B 102/32* | (2015.01) |
| *A63B 71/06* | (2006.01) |

(52) U.S. Cl.
CPC .... *A63B 57/357* (2015.10); *A63B 2071/0602* (2013.01); *A63B 2071/0694* (2013.01); *A63B 2102/32* (2015.10); *A63B 2225/093* (2013.01)

(58) Field of Classification Search
CPC ..... A63B 57/357
See application file for complete search history.

(56) References Cited

U.S. PATENT DOCUMENTS

| | | | | |
|---|---|---|---|---|
| 5,002,252 | A | 3/1991 | Setala et al. | |
| 6,164,613 | A | 12/2000 | Williams | |
| 6,428,422 | B1 | 8/2002 | Bennett | |
| 6,939,239 | B1 | 9/2005 | Ash | |
| 6,955,609 | B1 | 10/2005 | Hiltner, Jr. et al. | |
| D641,822 | S | 7/2011 | Corbin et al. | |
| 2003/0200912 | A1* | 10/2003 | Brock, Jr. | G09F 17/00 116/173 |
| 2006/0270487 | A1* | 11/2006 | Tu Teng | A63B 69/3614 473/256 |
| 2012/0056068 | A1 | 3/2012 | Maxwell | |
| 2016/0375327 | A1* | 12/2016 | Trigg | A63B 57/357 473/176 |

* cited by examiner

*Primary Examiner* — Michael Dennis
(74) *Attorney, Agent, or Firm* — Dinsmore & Shohl, LLP

(57) ABSTRACT

A marker for a golf flag having a hub constructed of a flexible, resilient material with a central opening dimensioned to receive and resiliently grip the golf flag. The hub also has an axially extending through slot so that the diameter of the opening can be varied by flexing the hub. A plurality of elongated spokes each have an inner end attached to the hub and an outer end spaced radially outwardly from the hub. A ring is attached to the outer end of the spokes and this ring has a through slot aligned with the hub through slot so that widening of both through slots by flexing the ring simultaneously enlarges the central opening of the hub.

5 Claims, 2 Drawing Sheets

GOLF FLAG MARKER

BACKGROUND OF THE INVENTION

I. Field of the Invention

The present invention relates to an attachment for a golf flag stick.

II. Description of Related Art

In the game of golf, each hole in a golf course is marked by a golf flag stick. The bottom of the pole is inserted into the golf hole while a flag is attached to the top of the flag stick. Consequently, the position of the hole on the golf green can be ascertained from a distance. This, of course, is particularly important since the position of the golf hole periodically changes throughout the golf season.

Once the golfers have all landed on the green, the flag stick is typically removed and set aside on the ground while the golfers putt their balls into the golf hole to complete the hole. Once all the golfers have putted their balls into the golf hole, the flag stick is retrieved and inserted into the flag hole to assist the next group of golfers.

While such golf flag sticks have been used in essentially an unaltered form for hundreds of years, they necessarily suffer certain disadvantages. One disadvantage of the golf flag stick is that, once it is removed from the hole at the initiation of the putting sequence for that hole, the flag stick lays flat on the ground. Retrieving the flag stick from its position laying flat on the ground, however, is difficult for many older players.

These flag sticks are also used to approximately mark the front to back position of the hole on the golf green. Typically, a second colored golf flag is attached to the flag stick, so that different colors indicate back of the green, center of the green, and front of the green. While such information is helpful, a more accurate indication of the position of the hole between the front and back of the green would prove more helpful.

SUMMARY OF THE PRESENT INVENTION

The present invention provides an attachment for a golf flag stick that overcomes all of the above-mentioned disadvantages of the previously known devices.

In brief, the attachment of the present invention includes a hub constructed of a flexible material such as plastic. The hub includes a central opening dimensioned to receive and resiliently grip the flag stick. In addition, the hub has an axial through slot which permits the diameter of the hub central opening to be increased somewhat by flexing the hub outwardly. This increases the diameter of the central opening of the hub to permit the position of the hub to be adjusted vertically on the flag stick from low to high positions.

A plurality of elongated spokes extend radially outwardly from the hub so that the spokes are generally perpendicular to the golf flag. A ring is then attached to the outer ends of the spokes thus attaching the spokes together at a position spaced from the flag stick. This ring also includes a through slot aligned with the through slot on the ring. Thus, the diameter of the hub central opening can be increased by flexing the ring outwardly to increase the space between the ends of the ring. Once the hub is positioned at the desired location on the golf flag, the ring is released and resiliently returns to its unflexed position. In doing so, the ring frictionally grasps the golf flag stick at the adjusted position of the attachment relative to the golf flag stick.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
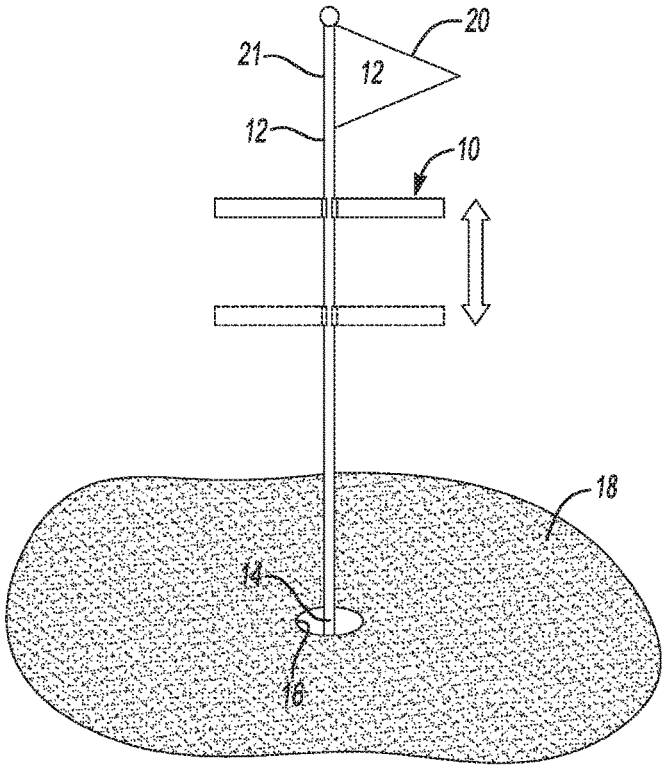
FIG. 1 is an elevational view of the attachment of the present invention in use, inserted into a golf hole.

With reference first to FIG. 1, a preferred embodiment of an attachment 10 for a golf flag stick 12 is shown. The golf flag stick 12 is conventional in construction and is generally circular in cross-sectional shape. A bottom 14 of the flag stick 12 is removably positioned within a golf hole 16 on a golf green 18 to mark the position of the golf hole 16 from afar. A golf flag 20 is also typically attached to the top 21 of the flag stick 12.

Figure 3:
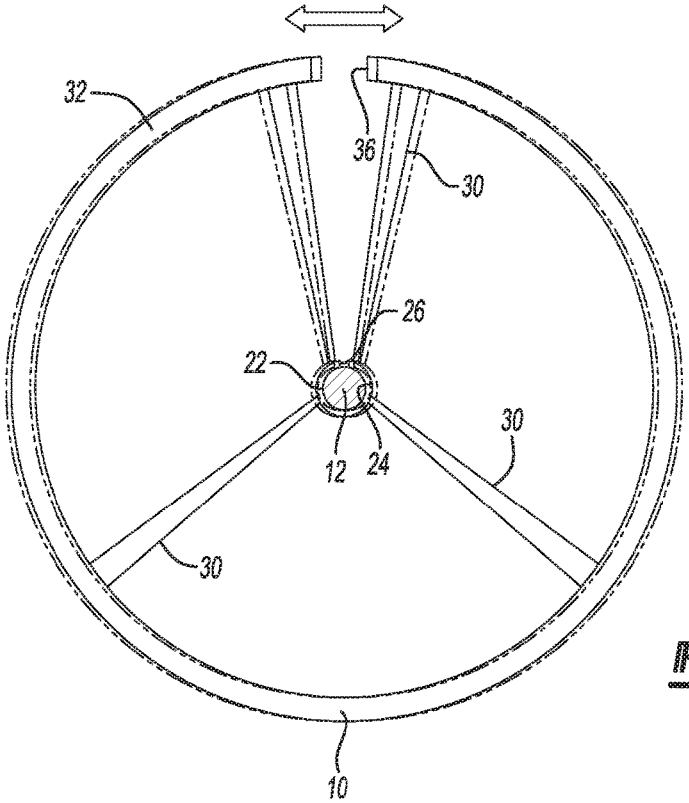
FIG. 3 is a top view of the attachment.
Figure 4:
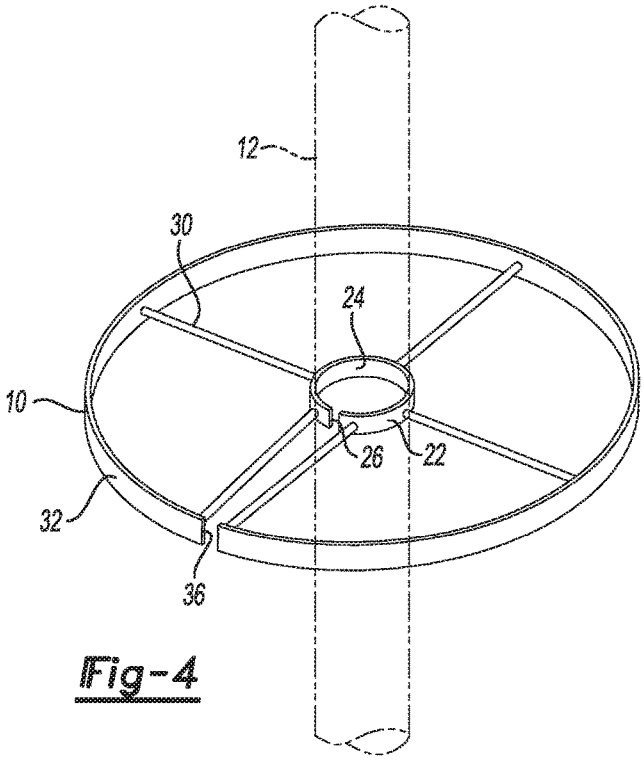
FIG. 4 is an elevational view of the attachment.

With reference now to FIGS. 3 and 4, the attachment 10 is there shown in greater detail and includes a central hub 22. The hub 22 is generally circular in shape and includes a central through bore 24. The through bore 24 is also generally circular in shape and is slightly smaller in diameter than the diameter of the golf pole 12.

Figure 5:
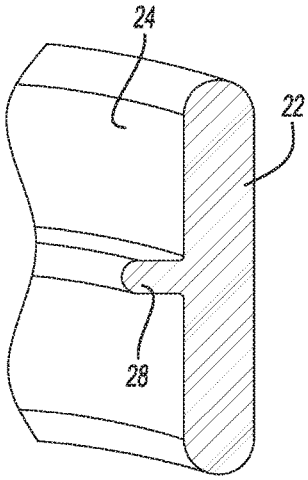
FIG. 5 is an exploded view of the hub and with parts removed for clarity.

In a manner which will be subsequently described, the hub 26 is dimensioned to fit around and resiliently grip the flag stick 12. In order to reduce the amount of friction between the hub 22 and the flag stick 12, the hub 22 includes a radially inwardly projecting rim 28 (FIG. 5). This rim 28 has an axial length much less than the axial length of the hub 22 to limit the frictional engagement between the hub 22 and the flag stick 12.

With reference to FIGS. 3 and 4, the hub 22 is constructed of a flexible, resilient material, such as plastic. Consequently, the through slot 26 in the hub enables the hub 22 to be slid along the flag stick 12 to the desired position when the hub 22 is flexed outwardly as shown in phantom line thus expanding the diameter of the hub throughbore 24. Upon releasing the hub 24, the hub 24 returns to its original position and resiliently grips the outer periphery of the flag stick thus preventing further movement of the hub 22 along the flag stick 12.

A plurality of radial spokes 30 each have their inner ends attached to the hub 22 so that the spokes 30 extend radially outwardly from the hub 22. A ring 32 then extends around and is secured to an outer end 34 of each of the spokes 30. This ring 32, however, includes a through slot 36 which is aligned with the through slot 26 formed through the hub 22. Furthermore, at least one of the hubs 30 is preferably attached to each side of the slot 36.

In a preferred embodiment, the ring 32, hubs 30, and hub 24 all comprise a one piece construction made from a flexible material, such as plastic. Furthermore, although only four spokes are illustrated as extending between the hub 22 and the ring 32, it will be understood that more or fewer spokes 30 may extend between the hub 22 and ring 32 without deviation from either the spirit or scope of the invention.

In operation and with reference to FIGS. 1 and 3, in order to attach the attachment 10 to the flag stick 12, the ring 32 is gripped on opposite sides of its through slot 36 and moved from the relaxed position shown in solid line and to the expanded position shown in phantom line in FIG. 3. In doing so, the ring automatically increases the diameter of the hub bore 24 so that the hub bore 24 can be easily slid along the flag stick 12. When the attachment 10 is positioned as desired along the flag stick 12, the attachment 10 is released. When released, the resiliency of the material of the attachment 10 will attempt to return the attachment 10 to its original size. In doing so, the hub 24 resiliently grips the flag stick 12 and secures the attachment to the flag stick 12 at its vertically adjusted position.

In use, the position of the attachment 10 along the flag stick is infinitely adjustable. As such, the attachment 10 may be adjustably secured to the flag stick at a position which more accurately reflects the position of the golf hole between the front and the back of the golf green 18 than the previously known three-position system.

Figure 2:
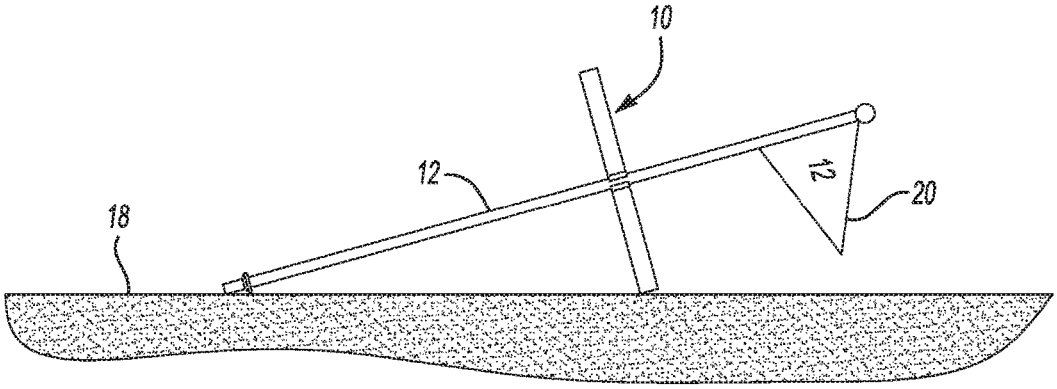
FIG. 2 is a front view of the attachment with the golf flag removed from the hole.

Furthermore, and with respect to FIG. 2 of the drawing, once the flag stick 12 with the attachment 10 is removed from the golf hole 16 and placed on the ground, the attachment 10 maintains the top of the flag stick 12 in an elevated position. This greatly facilitates retrieving the golf flag 12 when reinsertion of the golf flag 12 in the golf hole 16 is required.

A primary advantage of the present invention is that the flag end of the flag stick is elevated above the ground by the ring. This facilitates picking up the flag stick when reinsertion of the flag stick in the hole is necessary.

From the foregoing, it can be seen that the present invention provides a simple and yet highly effective attachment for a golf flag stick which not only facilitates grasping and lifting the flag stick 12 after it has been removed and positioned on the ground, but also provides a simple yet effective way for indicating the distance between the golf hole and the front and the back of the golf green. Having described my invention, however, many modifications thereto will become apparent to those skilled in the art to which it pertains without deviation from the spirit of the invention as defined by the scope of the appended claims.

We claim:

1. An attachment for a golf flag stick comprising:

a hub constructed of a flexible resilient material, said hub having a central opening dimensioned to receive and resiliently grip the golf flag, said hub having a first slot communicating with the central opening, a plurality of spokes, each spoke having an inner end attached to said hub, said spokes extending substantially radially outwardly from said hub and engaging, at outer ends, to a ring constructed of a flexible resilient material and surrounding said hub, a second slot in said ring communicating an exterior of said ring with said hub, a subset pair of said plurality of spokes located on opposite sides of each of said first and second slots; and separating said subset pair of spokes causing flexing of both said hub and ring for facilitating passage of the golf stick between the exterior of said ring and the central opening of said hub and/or for reposition-ably adjusting said hub at locations along the flag stick.

2. The attachment as defined in claim 1 wherein said hub, said spokes and said ring are of a one piece construction.

3. The attachment as defined in claim 1 wherein said hub is made of plastic.

4. The attachment as defined in claim 1 wherein said hub includes a radially inwardly projecting rim, said hub slot being formed through said rim.

5. The attachment as defined in claim 1 wherein said ring is circular in shape.

* * * * *